United States Patent [19]

Morell

[11] Patent Number: 4,973,057

[45] Date of Patent: Nov. 27, 1990

[54] GOLF BALL

[75] Inventor: Joseph Morell, Annecy, France

[73] Assignee: Salomon S.A., Annecy, France

[21] Appl. No.: 443,718

[22] Filed: Nov. 28, 1989

[30] Foreign Application Priority Data

Nov. 29, 1988 [FR] France ..... 88 15568

[51] Int. Cl.[5] ..... A63B 37/14

[52] U.S. Cl. ..... 273/232; 40/327

[58] Field of Search ..... 273/232; 40/327

[56] References Cited

U.S. PATENT DOCUMENTS 4,762,326 8/1988 Gobush ..... 273/232

4,772,026 9/1988 Gobush ..... 273/232

FOREIGN PATENT DOCUMENTS 217483 4/1987 European Pat. Off. ..... 273/232

735555 8/1932 France ..... 273/232

*Primary Examiner*—George J. Marlo

[57] ABSTRACT

The present invention relates to a golf ball.

The peripheral surface of the ball has dimples defining, by their intersections with this peripheral surface (2), intersection circles (44,49,54,59,63) distributed essentially inside 6 first identical elemental surfaces (24) in four-sided regular spherical polyganol form, and 8 second identical elemental surfaces (22) in spherical equilateral triangle form, which elemental surfaces (22,29) are defined by 4 equitorial circles (18,19,20,21) of the sphere defining the general shape of the peripheral surface (2) of the ball (3), each of the equatorial circles (18,19,20,21) being centered on an axis passing through two diametrically opposed apices of a cube inscribed in this sphere; if there is defined as a diagonal circle of a first elemental surface (22) a circular arc (35,36) centered on the center (13) of the sphere (1) and joining two opposed apices (30,31,32,33) of the said regular spherical polygon, certain (44,49,54) of the said intersection circles (44,49,54,59,63) are arranged on the said diagonal circular arcs (35,36).

As a function of the diameter attributed to the intersection circles (44,49,54,59,63) one can either render substantially unimportant the orientation of the ball with respect to the strike, or permit sufficient visualization of the elemental surfaces (22,29) for the player to be able to choose a strike zone.

25 Claims, 4 Drawing Sheets

GOLF BALL

The present invention relates to a golf ball of the type having a peripheral surface having the general shape of a sphere and a plurality of dimples arranged in the said peripheral surface and defining by their intersections with this intersection circles distributed on the said peripheral surface in accordance with a repetitive motif determined by subdivision of the said peripheral surface along circular arcs centred on the centre of the sphere, and determined as a function of a cube inscribed in the sphere, the said subdivision being carried out along 4 equatorial circles of which each is centred on an axis passing through 2 diametrically opposed apices of the cube in a manner to define 6 first identical elemental surfaces in regular spherical four-sided polygonol form and 8 second identical elemental surfaces in spherical equilateral triangular form, and the said intersection circles being distributed essentially inside the said first and second elemental surfaces.

A golf ball of this type is described in U.S. Pat. No. 4,762,326 which, however, recommends a more complex subdivision in that it embodies a total of 7 equatorial circles which, in addition to defining the said first and second elemental surfaces, subdivide each of the said first elemental surfaces into 4 spherical right-angle isosceles triangles in each of which intersection circles of the same diameter are distributed in accordance with different motifs.

The different motifs proposed in the mentioned U.S. patent lack homogeneity in that they allow the existence between the intersection circles of areas of the spherical peripheral surface having variable shapes and sizes, distributed in a manner such that it is difficult to discern them without a particularly careful examination, so that it is difficult for a player to orient his ball in a manner to be certain of striking it with a significant probability of hitting the peripheral surface of the ball in zones of this surface having a geometry substantially identical for each strike, for ensuring the reproducability of strikes.

The object of the present invention is to remedy this inconvenience, by proposing a mode of subdivision of the peripheral surface of the ball and a mode of distribution of the circles of intersection of the dimples with this surface permitting the player to be certain of striking the ball in a zone of known geometry, either permitting him to clearly discern this distribution for orienting at will his ball and consequently striking it in a determined zone of known geometrical conformation, or rendering this distribution as uniform as possible to then render the reproduceability of strikes substantially independent of the orientation of the ball.

For this, the golf ball according to the invention, of the type indicated in the preamble, is characterised in that, if there is defined as a diagonal circular arc of a first elemental surface a circular arc centred on the centre of the sphere and joining two opposite apices of the said regular spherical polygon, certain of the said intersection circles are positioned on the said diagonal circular arcs.

In other words intersection circles are positioned on certain of the equatorial circles defining the characteristic subdivision of the teachings of the mentioned U.S. Patent.

The distribution of the intersection circles essentially inside the elemental surfaces having dimensions sufficiently large and a number sufficiently low so that they are easily visually discernable on the ball permits the player to orient this ball at will suitably for the strike, that is to say to ensure from this that this strike hits one or another of the elemental surfaces in a determined zone, for example in a central zone of this elemental surface, for obtaining a desired effect.

This visible differentiation of different elemental surfaces can be accentuated by a recognizable differentiation of respective diameters or/and distributions of the intersection circles situated respectively in the first elemental surfaces and in the second elemental surfaces, but trials have shown that even in the case of circles having substantially neighbouring respective diameters in the first and second elemental surfaces, the visual discrimination between these latter is eased.

However, it is also possible to give the intersection circles situated in the first and second elemental surfaces substantially neighbouring diameters and to distribute them in a substantially uniform way throughout these elemental surfaces; the visual differentiation of the latter becomes more difficult, but the orientation of the ball with respect to the strike becomes substantially immaterial so that this difficulty remains of no importance.

Preferably, the intersection circles are distributed according to an identical motif in each of the identical elemental surfaces, that is to say in the first identical elemental surfaces on the one hand and in the second identical elemental surfaces on the other hand, but the scope of the present invention will not be departed from by providing other dispositions in this respect, and particularly in providing several disposition motifs for the intersection circles in the identical elemental surfaces, for offering the player a choice between different geometrical characteristics as regards the zone that he will strike.

The subdivision recommended in accordance with the present invention presents in addition an advantage in terms of the ease of fabrication of the ball. In effect, thanks to the recommended subdivision, it is possible that at least one determined equatorial circle, amongst the said equatorial circles, cuts none of the intersection circles. This determined circle can correspond to a joint plane when the ball is made by assembly of two identical core halves or when at least one surface layer of it, having the dimples, is made by moulding in a single piece in a mould itself formed of two assembled identical halves; it can then be permitted that one of the halves of the ball's mould, respectively, is angularly displaced with respect to the other half about the axis of the mentioned determined equatorial circle; in effect, either the differentiation between the different elemental surfaces is facilitated by a visually recognizable difference of the distribution of intersection circles and their diameters, in which case such a mutual angular displacement of the two halves of the ball or of the mould has no influence as regards the possibility for the player to choose the orientation of the ball, or the motif of distribution of the intersection circles in the different elemental surfaces and the choice of a substantially uniform diameter of these intersection circles renders the orientation of the ball substantially unimportant, and this angular displacement remains also of no importance. Naturally, the said determined equatorial circle subdivides each of the other said equatorial circles into two circular arcs, of which each corresponds to one of two hemispheres defined by the said determined equatorial circle and, in the case of such an angular displacement, the equatorial circular arcs of one of the hemispheres are displaced angularly, with respect to the respectively corresponding equatorial circular arcs of the other of the hemispheres, by the same amount about the axis of the said determined equatorial circle. The fact of permitting such a disposition considerably eases the manufacture of the ball by assembly of two halves or by moulding in a mould formed of two assembled halves, since it is not necessary to carry out a precise adjustment of the relative angular position of the two halves of the ball or of the mould, respectively, in manufacture of the ball.

For rendering more homogeneous the distribution and shape of the areas of the spherical peripheral surface existing between the intersection circles on each of the hemispheres as defined by the said determined equatorial circle, one can provide that the ball has an intersection circle about one, at least, of the points of intersection of the said equatorial circular arcs and, preferably, about each of these points of intersection respectively.

Naturally, one can also provide that none of the equatorial circles cuts anyone of the intersection circles.

Other characteristics and advantages of a ball in accordance with the present invention will appear from the description below, relating to three non-limitative embodiments, as well as from the accompanying drawings which form an integral part of this description.

Figure 5:
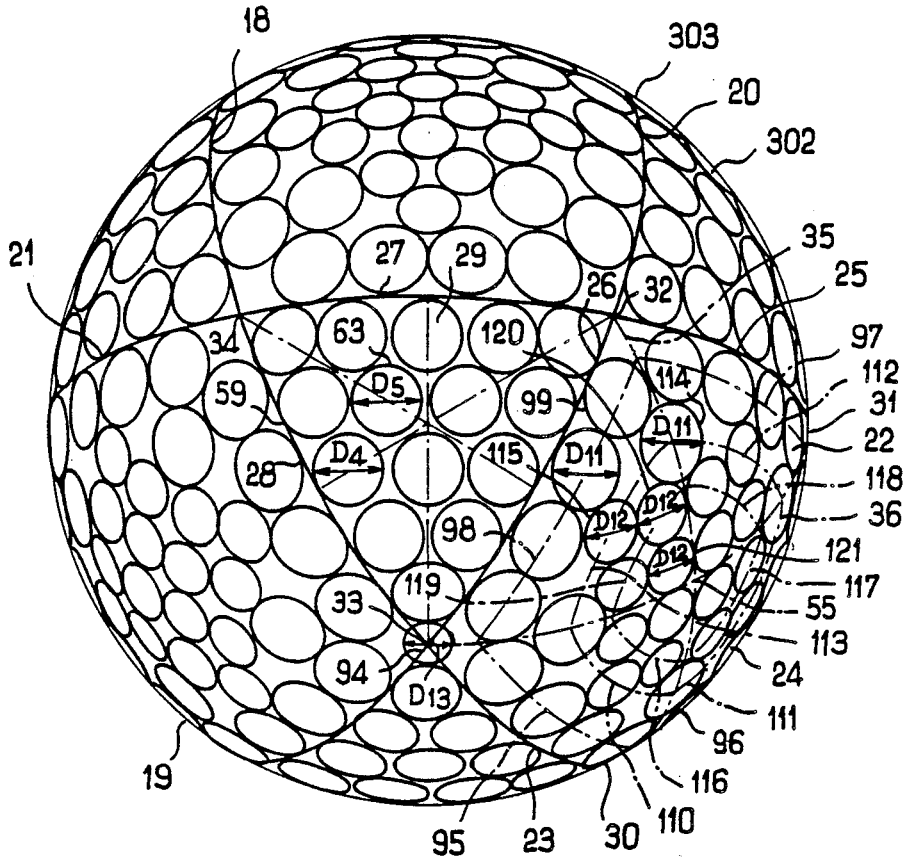

FIG. 5 shows a golf ball of which the dimples, or more precisely the intersection circles of these dimples with the peripheral surface of the ball, are distributed with most of them in the elemental surfaces obtained by the said subdivision by means of 4 equatorial circles, and which further comprise such dimples or intersection circles respectively about each of the points of intersection of two arcs of three of the said equatorial circles resulting from the subdivision of these three equatorial circles by the fourth of the said equatorial circles.

Figure 6:
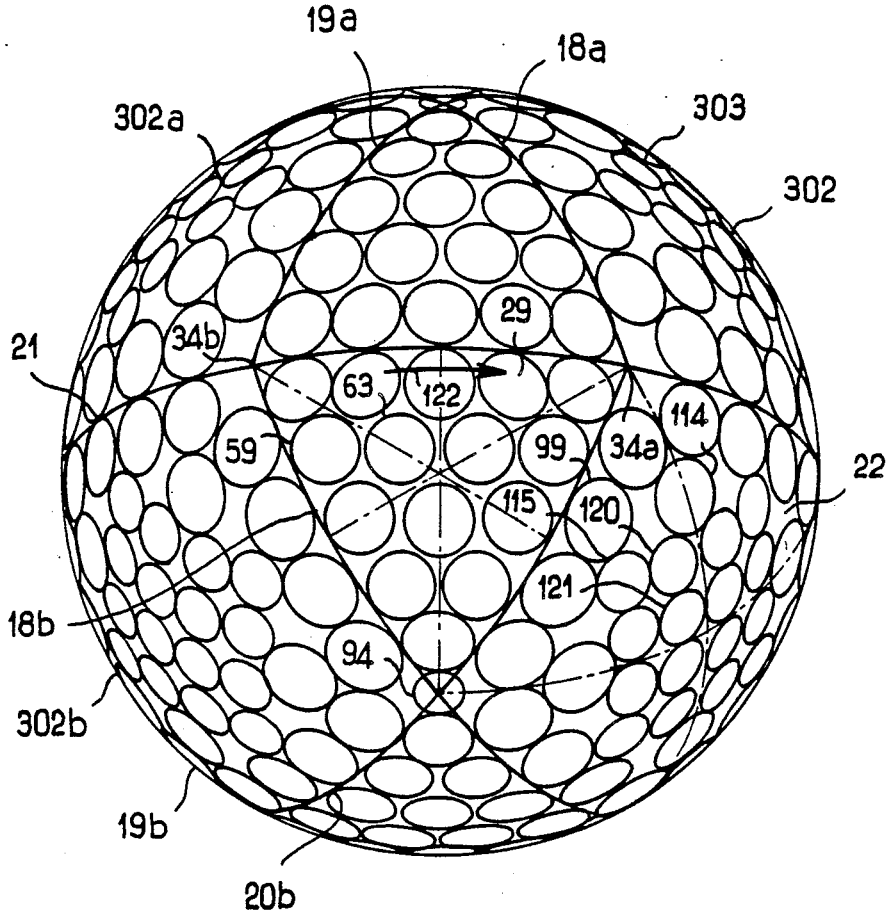

FIG. 6 shows a ball similar to that of FIG. 5, except that one of the two hemispheres defined by the said fourth equatorial circle is angularly displaced, about the axis of this equatorial circle, with respect to the other of these two hemispheres.

Figure 1:
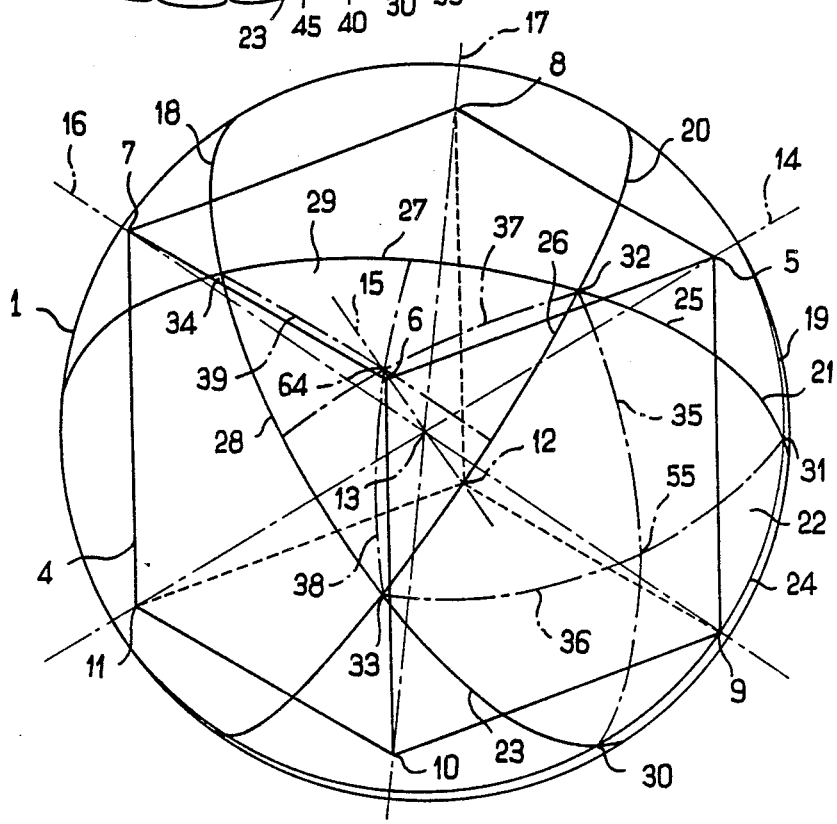
FIG. 1 illustrates the construction, in accordance with the present invention, of 4 equatorial circles on a sphere from a cube inscribed in this latter.

Referring in the first place to FIG. 1, where there is designated by 1 a sphere having the general form of the peripheral surface 2,102,202,302 of golf balls 3,103, 203,303, illustrated respectively in FIGS. 2, 3, 4, 5 and by 4 a cube inscribed in this sphere 1 on which it has 8 apices 5 to 12; the cube 4 and the sphere 1 having a common centre 13 which will serve as a reference when referring, below, to the notation of diametrically opposed positions.

For geometrical reasons, the apices 5 to 12 of the cube are diametrically opposed in pairs and, according to the present invention, there are defined 4 axes 14,15,16,17 of which each passes through two diamterically opposed apices of the cube 4, that is to say respectively the apices 5 and 11, 6 and 12, 7 and 9, 8 and 10.

About each of these axes 14 to 17 is set out, on the sphere 1, a respective equatorial circle 18,19,20,21 of which each cuts the three others at two points of intersection.

There appear in FIGS. 2 to 5, on the peripheral surface 2,102,202,302 of the balls 3,103,203,303, the three equatorial circles 18,20,21 which are the most visible as a result of their positioning; it will be noted however that it is not necessary that any of these three equatorial circles, nor the equatorial circle 19, be materially reproduced on the surface 2,102,202,302. In fours, the 4 equatorial circles 18 to 21 define 6 identical elemental surfaces 22, which are regularly distributed on the sphere 1 and of which each has the shape of a regular spherical polygon with four sides 23,24,25,26, of which each is constituted by an arc of a respective equatorial circle.

In threes, the equatorial circles 18,19,20,21 delimit between them 8 identical elemental surfaces 29 in spherical equilateral triangular form, which are regularly distributed on the sphere 1 and ars delimited by three sides 26,27,28 of which each constitutes an arc of a respective equatorial circle; it will be noted that each side of one of the spherical equilateral triangles 29 constitutes also one side of a respective regular spherical polygon 22.

There are designated respectively by 30,31,32,33, four apices of the regular spherical polygon 22; each of the apices 30 to 33 is constituted by a point of intersection of two respective equatorial circles 18 to 21 and is common on the one hand with one other respective regular spherical polygon with four sides, and on the other hand with two respective equilateral spherical triangles; there are designated by 32,33,34, three apices of an equilateral triangle 29, which are defined in the same manner as the apices of a regular spherical polygon 22 with four sides.

There will be found the elemental surface 22,29, their sides 23 to 26 and 26 to 28 and their apices 30 to 33 and 32 to 34 in FIGS. 2, 3, 4, 5, where there also appear, as in FIG. 1, two circular arcs 35,36 and three circular arcs 37,38,39 of the sphere 1, on the centre 13 of which these circular arcs are centred.

The circular arc 35 joins the opposite apices 30 and 32 of the four sided regular polygon 22, of which the circular arc 36 joins the two opposed apices 31 and 33, so that these circular arcs 35 and 36 will be designated below as diagonal circular arcs of the polygon 22. Similarly, there are illustrated at 37,38,39, three circular arcs centred on the centre 13 of the sphere 1 and of which each connects a respective apex 32,33,34 of an equatorial triangle 29 to the middle of the respective opposite edge of this 28,27,26 respectively; these circular arcs 37,38,39 will be designated below as median circular arcs of the elemental surface in the form of the equilateral triangle 29.

In a manner known in itself, in the spherical peripheral surface 2,102,202,302 of the ball 3,103,203,303 are arranged dimples which have for example the form of spherical depressions and define circles by their intersection with this peripheral surface 2,102,202,302.

According to the present invention, the intersection circles thus defined are integrally distributed (FIGS. 2 to 4), or at least the majority of them are (FIG. 5), in accordance respectively with determined motifs inside the elemental surfaces 22 and inside the elemental surfaces 29, without overlapping any of the equatorial circles in the three illustrated examples although such overlapping is permissible to a certain extent; preferably, nevertheless, one at least of these equatorial circles cuts none of the circles of intersection of the dimples with the peripheral surface 2,102,202,302 of the ball 3,103,203,303 to correspond to a joint plane between two halves of the ball if this is made in two halves, or between two halves of a mould intended for the manufacture of the ball, or at least of a surface layer of it comprising the dimples, in a single piece by moulding, in a manner not shown in FIGS. 2 to 5 and as will be described with reference to FIG. 6, this determined equatorial circle can then subdivide each of the other equatorial circles into two equatorial circular arcs which are mutually angularly displaced, by the same amount, about the axis of this equatorial circle, which involves no major inconvenience as has been indicated above; preferably, and without departing from the scope of the present invention in adopting a different disposition, the distribution motif for the dimples, that is to say the circles of intersection of these latter with the peripheral surface of the ball, is identical from one elemental surface 22 to another, as is the distribution motif for the dimples or intersection circles in the elemental surfaces 29, precisely, the four embodiments of the invention illustrated in FIGS. 2 to 5, respectively, reproduce all these preferred dispositions, in a manner which will now be described in more details.

There will be described first the embodiment of the invention illustrated in FIG. 2.

In this case, in each elemental surface 22, the circles of intersection of the dimple with the spherical peripheral surface 2 of the ball 3 are distributed in the following manner:

4 identical rows 40,41,42,43 of 6 mutually identical intersection circles 44, that is to say of the same diameter $D_1$ chosen so that the 6 circles of the same row are adjacent in pairs and adjacent to an edge 23,24,25,26 of the elemental surface 22 respectively neighbouring the row 40,41,42,43 to which these circles 44 belong, and that the circles 44 at the end of each row, which are common to a respective other one of these rows, are centred on a respective diagonal circular arc 35,36 of the elemental surface 22; the diameter $D_1$ can easily be determined, for this, by a man skilled in the art;

4 rows 45,46,47,48 each having 4 identical circles 49, that is to say of the same diameter $D_2$ greater than the diameter $D_1$ and chosen, in a manner easily determined by a man skilled in the art, so that in each of the rows 45,46,47,48 the circles 49 are adjacent in pairs and, further, to a respective circle 44 of one of the rows 40,41,42,43 respectively neighbouring the row 45,46,47,48 to which they belong, and that the end circles 49 of each of the rows 45,46,47,48, which are common in pairs of these, are centred on a respective diagonal circular arc 35,36, of the elemental surface 22;

4 rows 50,51,52,53 of which each has two circles of the same diameter $D_3$ greater than the diameter $D_2$ and chosen so that the two circles of each row are mutually adjacent, centred on a respective diagonal circular arc 35,36 of the elemental surface 22, and are in addition adjacent to one circle 49 of one of the rows 45,46,47,48 respectively neighbouring the row 50,51,52,53 to which they belong.

It will be noted that on each of the diagonal circular arcs 35,36 of the elemental surface 22, the intersection circles 44,49,54 are distributed in identical manner, between an apex 30,31,32,33 of the elemental surface 22 and a point 55 defined by the intersection of two diagonal circular arcs 35 and 36; the diameter of these circles, which succeed each other from one of the apices 30,31,32,33 to the point 55, or again from one of the edges 23,24,25,26 to this point 55, increase, $D_3$ being greater than $D_2$ which is itself greater than $D_1$ but these diameters remain however substantially neighbouring.

In a general manner, in the above description as well as in the following description, by "adjacent" is intended in respect of circles of intersection of a dimple with the peripheral surface 2,102,202 of the balls 3,103,203, either in pairs or vis-a-vis an edge delimiting an elemental surface which essentially contains them, a tangential relation or a mutual spacing which is small with respect to the diameter of the circles concerned, and for example at the most equal to a quarter of this diameter, this figure being indicated by way of non-limitative example.

Figure 2:
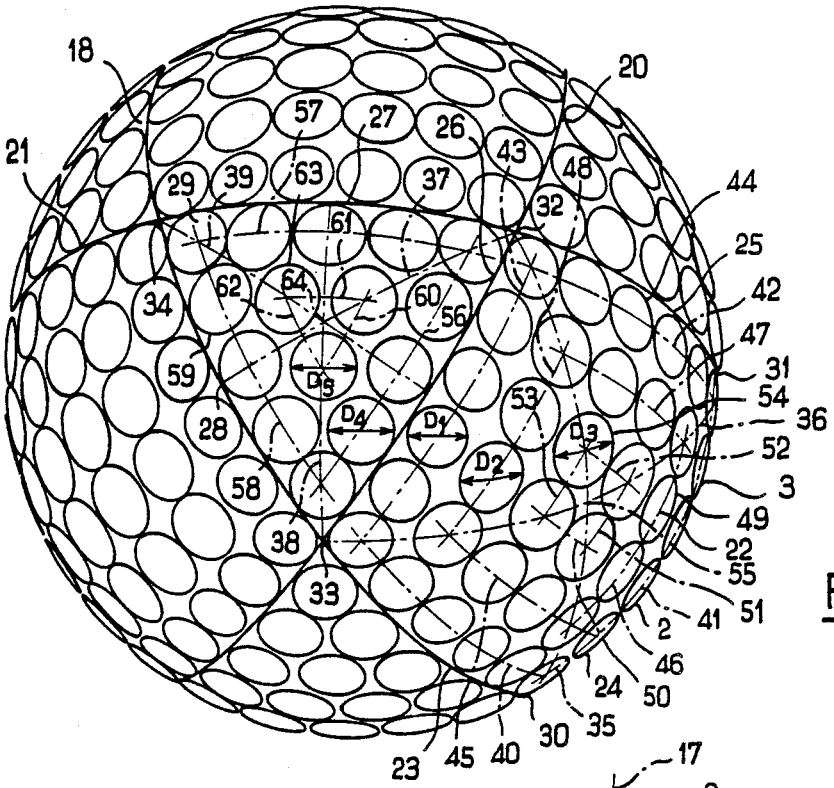
FIGS. 2 to 4 show three golf balls of which the dimples, or more precisely the intersection circles of the dimples with the peripheral surface of the ball, are distributed on the elemental surfaces obtained by this subdivision by means of 4 equatorial circles.

In each elemental surface 29, and in the case of the embodiment of the invention which is illustrated in FIG. 2, the circles of intersection of the dimples with the peripheral surface 2 of the balls 3 are distributed in the following manner:

3 identical rows 56,57,58 of 5 identical circles 59, having the same diameter $D_4$ of the same order of size as the diameter $D_2$ of the circles 49, this diameter being chosen so that, in each row 56,57,58, the circles 59 are mutually adjacent and are adjacent to an edge 26,27,28 respectively neighbouring the row 56,57,58 to which these circles 59 belong; further, the two end circles of each row 56,57,58 are centred on a respective median circular arc 37,38,39 of the elemental surface 29 and are common in pairs in the rows 56,57,58;

3 identical rows 60,61,62 each having 2 identical circles 63, of the same diameter $D_5$ substantially equal to $D_4$, these 2 circles being centred on a respective one of the median circular arcs 37,38,39 of the elemental surface 29 and the circles 63 being mutually adjacent in pairs as well as to four of the circles 59, belonging to the different rows 56,57,58.

It should be noted that on each of the median circular arcs 37,38,39, the circles 59 and 63 are distributed in an identical manner, at the rate of one circle 59, one circle 63 between each of the apices 32,33,34 of the elemental surface 29 and one point 64 defined as the point of intersection of the three median circular arcs 37,38,39 of this surface, and one circle 59 between each of the edges 26,27,28 of the elemental surface 29 and this point of intersection 64.

As with the diameters $D_1$, $D_2$, $D_3$, the diameters $D_4$ and $D_5$ can easily be determined by a man skilled in the art, as a function of the diameter of the peripheral surface 2 of the ball 3.

Figure 3:
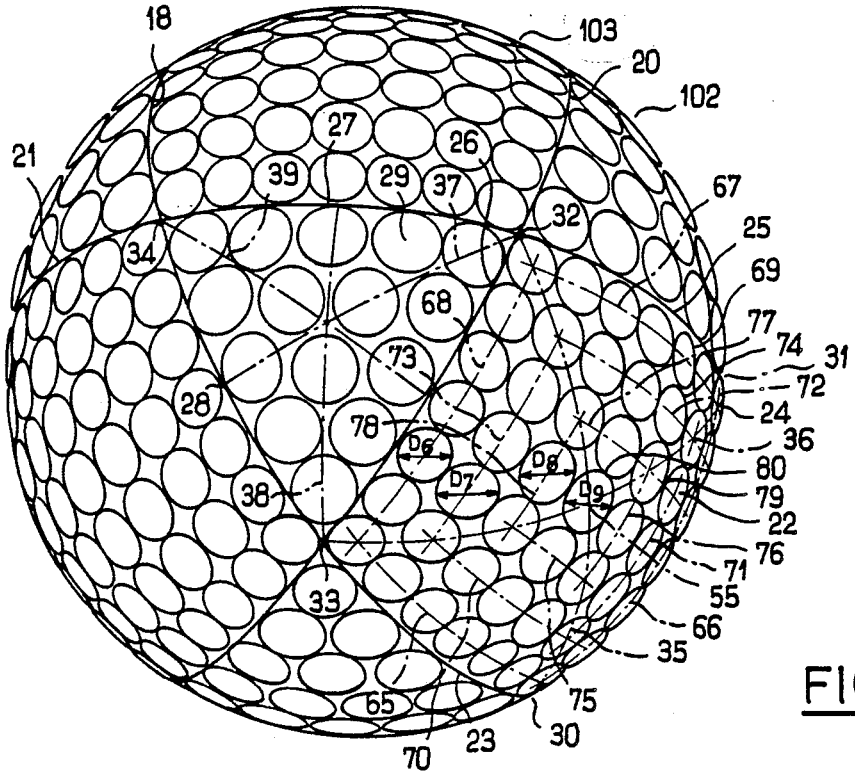

There will now be described in more detail the embodiment of the invention illustrated in FIG. 3, where there will be found the same distribution of circles of intersection of the dimples with the peripheral surface 102 of the ball 103 in the elemental surfaces 29, in equilateral triangle form, as in the case of the embodiment illustrated in FIG. 2 so that there will be described with reference to FIG. 3 only the mode of distribution of the circles of intersection of the dimples with the peripheral surface 102 of the ball 103 in the elemental surfaces 22.

In such an elemental surface 22, the intersection circles are distributed in the following manner:

4 identical rows 65,66,67,68 of 7 mutually identical intersection circles 69, that is to say of the same diameter $D_6$ less than $D_1$ and chosen so that the 7 circles of one row are adjacent in pairs and adjacent to an edge 23,24,25,26 of the elemental surface 22 respectively neighbouring the rows 65,66,67,68 to which the circles 69 belong, and that the end circles 69 of each row, which are common with a respective other one of the these rows, are centred on a respective diagonal circular arc 35,36 of the elemental surface 22; the diameter $D_6$ can be easily determined, for this, by a man skilled in the art;

4 rows 70,71,72,73 each having 5 identical circles 74, that is to say of diameter $D_7$ greater than the diameter $D_6$ and chosen, in a manner easily determined by a man skilled in the art, so that in each of the rows 70,71,72,73, the circles 74 are adjacent in pairs and, further, to a respective circle 69 of the rows 65,66,67,68 respectively neighbouring the rows 70,71,72,73 to which they belong and that the end circles 74 of each row 71,72,73, which are common in pairs of these, are centred on a respective diagonal circular arc 35,36 of the elemental surface 22;

4 rows 75,76,77,78 of which each has 3 circles 79 of the same diameter $D_8$ greater than the diameter $D_7$ and chosen so that the 3 circles of each row are adjacent in pairs, that each of them are further, adjacent to a respective circle 74 of a row 70,71,72,73 respectively neighbouring the row to which it belongs, and that the two end circles 79 of each of the rows 75,76,77,78, which are common in pairs of these, are centred on a respective diagonal circular arc 35,36 of the elemental surface 22;

1 central circle 80 centred on the point 55 and having a diameter $D_9$ greater than the diameter $D_8$, to which the circle 80 is adjacent at four circles 79 belonging respectively to the four rows 75,76,77,78.

It should be noted that in this case also, on each of the diagonal circular arcs 35,36 of the elemental surface 22, the intersection circles 69,74,79,80 are distributed in an identical manner, between an apex 30,31,32,33 of the elemental surface 22 and the point 55 of intersection of the two diagonal circular arcs 35 and 36; the diameter of the circles which succeed each other from one of the apices 30,31,32,33 to the point 55, or from one of the edges 23,24,25,26 to the point 55, increases. The diameters $D_6$, $D_7$, $D_8$, $D_9$ can easily be determined by a man skilled in the art, as a function of the diameter of the ball 103.

Figure 4:
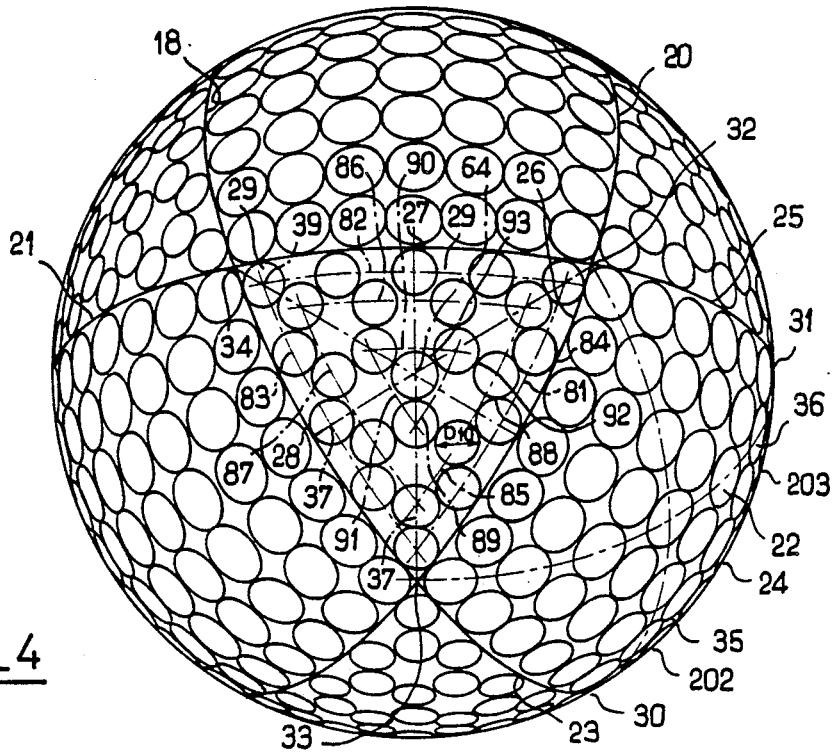

There will now be described the embodiment of the invention which is illustrated in FIG. 4, which differs from the embodiment illustrated in FIG. 3 only by the mode of distribution of the circles of intersection of the dimples with the peripheral surface 202 of the ball 203 in the elemental surfaces 29 of equilateral triangular form, so that the mode of distribution of the intersection circles in the elemental surfaces 22 will not be described, this remaining identical to that which has been described with reference to FIG. 3.

In the case of the embodiment illustrated in FIG. 4, the intersection circles are distributed in the following manner in each of the elemental surfaces 29:

3 identical rows 81,82,83 of 5 identical circles 84, having the same diameter $D_{10}$ substantially less than the diameter $D_6$ of the circle 69, this diameter $D_{10}$ being chosen so that, in each row 81,82,83, the circles 84 are mutually disjoint but are adjacent to an edge 26,27,28, respectively neighbouring the row 81,82,83 to which the circles 84 belong; further, the two end circles 84 of each of the rows 81,82,83 are centred on a respective median circular arc 37,38,39 of the elemental surface 29, and are common at two of the rows 81,82,83;

3 identical rows 85,86,87 of 4 identical circles 88, having the same diameter $D_{10}$ also chosen so that, in each row 85,86,87, the circles 88 are mutually disjoint but are adjacent to two of the circles 69 of the row 81,82,83 respectively neighbouring the row 85,86,87 to which the circles 88 belong; further, the end circles 88 of each of the rows 85,86,87 are centred on a respective median circular arc 37,38,39 of the elemental surface 29, and are common at 2 of the rows 81,82,83;

3 identical rows 89,90,91 each having 2 identical circles 92 of the same diameter $D_{10}$, these two circles being centred on a respective one of the median circular arcs 37,38,39 of the elemental surface 29 and these circles 92 being mutually disjoint but adjacent to two, respective, circles 88, belonging to two different rows 85,86,87;

one central circle 93 of the same diameter $D_{10}$, centred on the point 64 and adjacent to the three circles 92.

It will be noted that, on each of the median circular arcs 37,38,39, the circles 84,88,92,93 are distributed in an identical manner, that is to say at the rate of one circle 84, one circle 88, one circle 92 between each of the apices 32,33,34 of the elemental surace 29 and the central circle 23, and one circle 84 between each of the edges 26,27,28 of the elemental surface 29 and this central circle 93.

As with the diameters $D_1$ to $D_9$, the diameter $D_{10}$ can easily be determined by a man skilled in the art, as a function of the diameter of the peripheral surface 2 of the ball 3.

There will now be described the embodiment of the invention illustrated in FIG. 5, which differs from the embodiments of FIGS. 2 and 3, only on the one hand by the mode of distribution of the circles of intersection of the dimples with the peripheral surface 302 of the ball 303 in the elemental surfaces 22, so that the mode of distribution of the intersection circles in the elemental surfaces 29 will not be described, this remaining identical to that which has been described with reference to FIG. 2, and, on the other hand, by the presence of supplementary intersection circles 94 about the mutual intersections of the equatorial circles 18,19,20 whilst such intersection circles remain absent from any intersection of the equatorial circles 18,19,20 with the equatorial circle 21, chosen to correspond to a joint plane in manufacture of the ball 303; only the one of the supplementary intersection circles 94 is visible in FIG. 5, in practice around the point of intersection of the equatorial circles 18 and 20 corresponding to the apex 33 of an elemental surface 29, whilst the apices 32 and 34 of this, situated on the equatorial circle 21, are not provided with such intersection circles. This supplementary intersection circle 94 has a diameter $D_{13}$ less than the diameters $D_4$ and $D_5$ of the intersection circles 59 and 63 of an elemental surface 29 and chosen, in a manner easily determined by a man skilled in the art, such that this circle 94 is adjacent to two circles 59 belonging to two different elemental surfaces 29.

A man skilled in the art will easily deduce, from the disposition of the supplementary intersection circle 94 which is illustrated, the manner in which the supplementary intersection circles analogous to this one are arranged respectively around each of the intersection points of two of the equatorial circles 18,19,20. At least certain of the supplementary intersection circles can be omitted, in which case there will exist around each respectively corresponding intersection point an area of the spherical surface 302 of the ball 303 usable for example to receive a manufacturer's mark; naturally, these supplementary intersection circles can also be totally absent, in the same way that there can equally be provided, by using positions in the elemental surfaces 22 and 29, elemental circles different from those which have been illustrated in FIG. 5.

In the case of this embodiment of the invention, the intersection circles are distributed in the following manner in each elemental surface 22.

4 identical rows 95,96,97,98 of 4 mutually identical intersection circles 99, that is to say of the same diameter $D_{11}$ greater than $D_1$ and $D_9$ as well as than $D_4$ and $D_5$ and chosen such that the four circles of one row are adjacent in pairs and adjacent to an edge 23,24,25,26 of the elemental surface 22 respectively neighbouring the row 95,96,97,98 to which these circles 99 belong, and so that the end circles 99 of each of the rows are adjacent to a respective diagonal circular arc 35,36 of the elemental surface 22; the diameter $D_{11}$ can be easily determined for this, by a man skilled in the art;

4 rows 110,111,112,113 each having 4 mutually disjoint circles at the rate of two end circles 114 of the same diameter $D_{11}$ as the circles D99 of the rows 95,96,97,98 and one central circle 115 of diameter $D_{12}$ less than $D_{11}$ as well as than $D_4$ and $D_5$ but greater than $D_{13}$ and chosen so that in each range 110,111,112,113, the central circle 115 is adjacent to two respective intermediary circles 99 of a row 95,96,97,98 respectively neighbouring the row 110,111, 112,113 to which they belong whilst the end circles 114 of each of the rows 110,111,112,113, which are common in pairs of these, are centred on a respective diagonal circular arc 35,36 of the elemental surface 22 and adjacent to 2 circles 99 of which each constitutes an end circle of one of the rows 95,96,97,98;

4 rows 116,117,118,119 of which each has 2 circles 110 of the same diameter $D_{12}$ as the central circles 115 of the rows 110,111,112,113 and chosen so that the two, mutually disjoint, circles of each row are each adjacent to a respective end circle of one row 70,71,72,73 respectively neighbouring the row to which it belongs whilst a central circle 115 of this neighbouring row, and that the two circles 120 are adjacent to a respective diagonal circular arc 35,36 of the elemental surface 22;

4 circles 121 of which each has the same diameter $D_{12}$ as the circles 115 and 120 and is adjacent on the one hand to two circles 120 of one respectively neighbouring row 116,117,118,119 and on the other hand two diagonal circular arcs 35,36 of the elemental surface 22; the determination, in accordance with the different factors mentioned above, of the diameter $D_{12}$ will result from the normal aptitudes of a man skilled in the art.

It will be noted that in this case also, on each of the diagonal circular arcs 35,36 of the elemental surface 22, the intersection circles 114 are arranged in an identical manner, between an apex 30,31,32,33 of the elemental surface 22 and the point 55 of intersection of the two diagonal circular arcs 35 and 36.

FIG. 6 illustrates a golf ball 303 of which the peripheral surface 302 is subdivided in accordance with a variant of the subdivisions illustrated in FIGS. 1 to 5, this variant creating however elemental surfaces 22 and 29 of the same form as in the case of the subdivisions illustrated in FIGS. 1 to 5.

This variant of subdivision is constructed geometrically as has been described with reference to FIG. 1 except only that after having defined the equatorial circles 18 to 21 and subdivided by the equatorial circle 21 each of the other equatorial circles 18,19,20 into two circular arcs respectively 18*a* and 18*b*, 19*a* and 19*b*, 20*a* and 20*b*, in each of the hemispheres 2*a*, 2*b* defined by the equatorial circle 21, respectively, all the equatorial circles of one of these hemispheres are angularly displaced by the same amount, about the axis 17 of the equatorial circle 21, and in the same direction 122, so that the subdivision of each hemisphere 2*a*, 2*b* into elemental surfaces 20 and 29 remains unchanged with respect to that which has been described with reference to FIG. 5; neverthless, the two arcs of the same equatorial circle 18,19,20 no longer meet on the equatorial circle 21 but if, as is illustrated in FIG. 6, the value of this relative angular displacement of the 2 hemispheres is 60 , at a point 34*a* situated on the circle 21 for example the arcs of the equatorial circles 18*a* and 20*b* meet whilst at a point 34*b* also situated on the circle 21, displaced by 60 in the direction 72 with respect to the point 34*a*, the equatorial circular arcs 19*a* and 18*b* meet in this example.

In the case of this variant, there is found to be identical on each hemisphere 2*a* or 2*b*, not only the intersection circles 59,63,99,114,115,120,121 distributed in the elemental surfaces 22 and 29 as has been described with reference to FIG. 5, but also the supplementary intersection circles 94 situated around each of the respective points of intersection of two of the equatorial circular arcs 18*a*, 19*a*, 20*a* (not visible in FIG. 3) on the hemisphere 2*a* and 18*b*,19*b*,20*b* on the hemisphere 2*b*, it being understood that any other distribution particularly of the type described with reference to FIGS. 2 to 4 respectively can be adopted without departing from the scope of the present invention.

It will be noted that, in each of the embodiments of the invention which has been described and more particularly in those which have been described with reference to FIGS. 3 to 6, the orientation of the ball can be visualised easily, for permitting the player to choose to orient one of the elemental surfaces 22 or one of the elemental surfaces 29 towards the strike, with a characteristic relatively independent to the zone of the elemental surface chosen which effectively receives the strike on account of the good homogeneity of the intersection circles in each of the elemental surfaces, further, in the case of the embodiment illustrated in FIG. 2, the homogeneity of distribution of the intersection circles between the different elemental surfaces and their diameters is sufficiently good for it to be able to be considered that the orientation of the ball with respect to the strike is substantially unimportant.

Naturally, the embodiments of the invention which have been described constitute only nonlimitative examples, with respect to which there can be provided numerous variants without departing from the scope of the present invention.

I claim:

1. A golf ball comprising a peripheral surface having a general shape of a sphere and a plurality of dimples arranged in said peripheral surface, said dimples defining intersection circles where they intersect with said peripheral surface, said intersection circles being distributed on said peripheral surface in accordance with a repetitive motif determined by subdivision of said peripheral surface along circular arcs centred on a centre of said sphere and determined as a function of a cube inscribed in said sphere, said subdivision being carried out along 4 equatorial circles of which each is centred on an axis passing through 2 diametrically opposed apices of said cube in a manner to define 6 first identical elemental surfaces in the form of a regular spherical four-sided polygon and 8 second identical elemental surfaces in the form of a spherical equilateral triangle, and said intersection circles being distributed essentially inside said first and second elemental surfaces, wherein a diagonal circular arc of a first said elemental surface is defined as a circular arc centred on said centre of said sphere and joining two opposed apices of said regular spherical polygon, and certain of said intersection circles are arranged on said diagonal circular arc.

2. A ball according to claim 1, wherein at least a determined one of said determined equatorial circles cuts none of said intersection circles and subdivides each one of the others of said equatorial circles into two equatorial circular arcs, of which each corresponds to one of two hemispheres defined by said determined equatorial circle.

3. A ball according to claim 2, wherein said equatorial circular arcs of one of said hemispheres are angularly displaced with respect to respectively corresponding ones of said equatorial circular arcs of the other of said hemispheres, by the same amount about said axis of said determined equatorial circle.

4. A ball according to claim 2, including an intersection circle around one, at least, of points of intersection of said equatorial circular arcs.

5. A ball according to claim 2, including a respective intersection circle around each point of intersection of said equatorial circular arcs.

6. A ball according to claim 1, wherein none of said equatorial circles cuts any of said intersection circles.

7. A ball according to claim 1, wherein said intersection circles are distributed according to an identical said motif in identical ones of said elemental surfaces.

8. A ball according to claim 1, wherein said intersection circles are distributed, in a first said elemental surface according to a said motif comprising:

first said intersection circles distributed in an identical manner on said diagonal circular arcs, second said intersection circles distributed in rows of which each mutually connects two first said intersection circles occupying identical positions on said corresponding diagonal circular arcs.

9. A ball according to claim 8, two first said intersection circles occupying identical positions on said corresponding diagonal circular arcs, in a first said elemental surface, have the same diameter.

10. A ball according to claim 8, wherein two said rows occupying identical positions in a first said elemental surface are identical.

11. A ball according to claim 8, wherein said intersection circles of one said row in a first said elemental surface, have the same diameter.

12. A ball according to claim 11, wherein said intersection circles have a diameter increasing with increasing separation from said equatorial circle in a first said elemental surface.

13. A ball according to claim 8, wherein said intersection circles of the same said row, in a first said elemental surface, have different respective diameters.

14. A ball according to claim 13, wherein said second intersection circles have a diameter less than that of said first intersection circles situated in said first row.

15. A ball according to claim 8, said motif has in addition third said intersection circles distributed in rows of which each has two end intersection circles adjacent to a respective one of said diagonal circular arcs.

16. A ball according to claim 15, wherein said third intersection circles of a same one of said rows have the same diameter.

17. A ball according to claim 1, wherein one said intersection circle is arranged at an intersection of two said diagonal circular arcs in a first said elemental surface.

18. A ball according to claim 1, wherein a median circular arc of a second elemental surface is defined as a circular arc centred at said centre of said sphere and joining an apex of said spherical equilateral triangle at a midpoint of an edge of said spherical equilateral triangle opposite from said apex, said intersection circles are distributed, in a second said elemental surface, according to a motif comprising:

fourth said intersection circles distributed in an identical manner on said median circular arc, fifth said intersection circles distributed in rows of which each mutually connects two fourth said intersection circles occupying identical positions on said corresponding median circular arcs.

19. A ball according to claim 18, wherein fourth said intersection circles occupying identical positions on said corresponding median circular arcs, in a second said elemental surface, have the same diameter.

20. A ball according to claim 18, wherein two said rows occupying identical positions in a second said elemental surface are identical.

21. A ball according to claim 18, wherein said intersection circles of a same said row in a second said elemental surface have the same diameter.

22. A ball according to claim 18, wherein an intersection circle is arranged at an intersection of said median circular arcs in a second said elemental surface.

23. A ball according to claim 18, wherein said intersection circles have the same diameter in a second said elemental surface.

24. A ball according to claim 1, wherein said intersection circles corresponding respectively to said first elemental surfaces and to said second elemental surfaces have diameters substantially different and/or distributions substantially different respectively in said first and second elemental surfaces.

25. A ball according to claim 1, wherein said intersection circles corresponding to said first and second elemental surfaces have substantially neighbouring diameters and substantially uniform distributions in said first and second elemental surfaces.

* * * * *